US006196038B1

(12) United States Patent
Chappoux

(10) Patent No.: US 6,196,038 B1
(45) Date of Patent: Mar. 6, 2001

(54) TUMBLER LOCK WITH ADDITIONAL ROTOR LOCKING MEMBER

(75) Inventor: Claude Chappoux, Chaponost (FR)

(73) Assignee: Ronis, Lyon Cedex (FR)

( * ) Notice: Subject to any disclaimer, the term of this patent is extended or adjusted under 35 U.S.C. 154(b) by 0 days.

(21) Appl. No.: 09/424,663

(22) PCT Filed: May 28, 1998

(86) PCT No.: PCT/FR98/01064

§ 371 Date: Feb. 1, 2000

§ 102(e) Date: Feb. 1, 2000

(87) PCT Pub. No.: WO98/54427

PCT Pub. Date: Dec. 3, 1998

(30) Foreign Application Priority Data

May 28, 1997 (FR) ..... 97/06554

(51) Int. Cl.[7] ..... E05B 27/00
(52) U.S. Cl. ..... 70/492; 70/356; 70/383
(58) Field of Search ..... 70/492, 356, 382–385, 70/423, 424, 453, 454

(56) References Cited

U.S. PATENT DOCUMENTS

| | | | | |
|---|---|---|---|---|
| 2,083,859 | | 6/1937 | North | 70/319 |
| 3,290,910 | * | 12/1966 | Laviana | 70/383 |
| 3,499,209 | * | 3/1970 | Laviana | 70/492 X |
| 3,555,859 | * | 1/1971 | Berkowitz | 70/492 X |
| 3,581,534 | * | 6/1971 | Testa | 70/492 X |
| 3,754,422 | * | 8/1973 | Stackhouse | 70/492 |
| 3,956,912 | * | 5/1976 | Broska | 70/492 |
| 4,253,320 | * | 3/1981 | Schwab et al. | 70/356 X |
| 4,296,618 | * | 10/1981 | Guiraud | 70/492 X |
| 4,357,815 | * | 11/1982 | Kleefeldt et al. | 70/492 X |
| 4,385,510 | * | 5/1983 | Harper | 70/492 |
| 4,712,402 | * | 12/1987 | Monahan | 70/384 X |
| 4,729,231 | * | 3/1988 | Wu | 70/383 |
| 4,966,021 | * | 10/1990 | Boag | 70/383 |

FOREIGN PATENT DOCUMENTS

| | | |
|---|---|---|
| 1384183 | 4/1965 | (FR) . |
| 2396853 | 2/1979 | (FR) . |

* cited by examiner

*Primary Examiner*—Suzanne Dino Barrett
(74) *Attorney, Agent, or Firm*—Young & Thompson

(57) ABSTRACT

A tumbler lock with an additional rotor locking member includes a rotor rotating in a stator bore. The lock includes a slide movable transversely to the key channel, the slide including a key passage orifice and a projection co-operating with a stator housing in a position locking the rotor rotation and elastically returned in the locking position by an elastic return, the slide having at least a notch co-operating with a key member so as to drive the slide transversely towards a position unlocking the rotor rotation.

9 Claims, 5 Drawing Sheets

TUMBLER LOCK WITH ADDITIONAL ROTOR LOCKING MEMBER

BACKGROUND OF THE INVENTION

The present invention relates to a tumbler lock with a supplemental member for locking the rotation of the rotor, of the type comprising a barrel or a rotor turning in a bore of a lock body or a stator, said rotor comprising a longitudinal blind slot provided with an inlet for a key for the introduction of a serrated key, said rotor comprising a plurality of transverse slots passing through and crossing the longitudinal slot in each of which is mounted a tumbler urged outwardly of the rotor by a spring, each tumbler comprising an opening arranged to be traversed by the key whose serrations coact with the edge of said openings, the tumblers being all deflected by the introduction of the serrated key corresponding to the combination of the lock, the bore of the stator comprising a hollow for the reception of each tumbler projecting from the rotor.

Tumbler locks have received considerable development because of their simplicity, implying a low price, associated with good resistance to picking with tools acting on the tumblers.

To improve further the security supplied by such locks, in particular so as to offer a wider range of combinations, the object of the present invention is to provide a tumbler lock comprising a supplemental member for locking the rotation of the rotor, said member being of different structure from the tumblers.

In U.S. Pat. No, 2,083,859, there is disclosed a combination lock whose combination is easily modifiable with the help of a key having two fingers engaging in the lock to act on a coupling element between the button frame and one of the permutation discs. This coupling element is constituted by a ring having a projection engaging in part in a notch provided on a portion of the combination disc and a portion in engagement in a notch of the frame button. An element movable transversely relative to the cylinder permits locking the coupling element in the coupled position, during engagement of the key, to modify the combination, the latter acts on said movable element which slides transversely so as to free said coupling element which is then inactive. This transversely movable element ensures locking of the coupling between the frame button and the permutation disc but does not ensure locking per se of the lock.

Also, and again in the interest of increasing the security offered by such locks, it is of interest to provide a tumbler lock whose combination can be changed by the user so as to offer a greater flexibility of use of this type of lock, in particular by permitting a limitation of access and/or modification of the combination of a lock of this type.

There is known from FR-A-1 384 183, a lock of the type comprising a recess in which is rotatably mounted the barrel to actuate a bolt, several grooves surrounding the barrel and adapted to be transversely adjusted in the recess, these grooves receiving tumblers so as to block the rotation of the barrel and being maintained in engagement with each other, said grooves being adapted to be unlocked from each other so as to permit the tumblers to adapt to the contour of a new key introduced through these tumblers. This lock moreover comprises a tumbler incurring no locking by coaction with the grooves or with the recess but which retains the key and whose particular sliding is ensured by grooves provided in said recess. Moreover, the locking mechanism described in this document to obtain a modifiable combination of the tumblers is relatively complex.

There is known from FR-A-2 396 853, a locking mechanism actuable first by a provisional key and then by a final key. This lock comprises a stator and a rotor disposed in the stator and an assembly of members projecting from the rotor in the stator so as to block the rotation of the rotor in the stator. Certain members are maintained, by a locking pin, in a position to free the rotor in the stator whilst others are active. Thus, a provisional key is arranged to act on only these active members. So as to pass into the final key position, the locking pin is withdrawn, which frees the members which were thus far inactive. An intermediate plate playing no active role in the freeing of the rotor relative to the stator is also freed by withdrawal of the locking pin and is positioned to play a protective role, in particular by masking the access to the opening through which was engaged the locking pin.

This lock arrangement has the drawback that its combination can be modified only once by operating on a portion of its fittings.

In these locks, it is necessary to modify the combination of the tumblers to modify the combination of the lock. Thus, another object of the invention is to provide a lock with tumblers provided with a supplemental locking member whose combination is easily changeable.

SUMMARY OF THE INVENTION

To this end, the invention has for its object a lock with tumblers with a supplemental locking member for the rotation of the rotor, of the type comprising a barrel or rotor turning in a bore of a lock body or stator, this rotor comprising a longitudinal blind slot provided with a key inlet for the introduction of a serrated key, said rotor comprising a plurality of transverse slots passing through and crossing the longitudinal slot, in each of which is mounted a tumbler pressed outwardly of the rotor by a spring, each tumbler comprising an opening arranged to be traversed by the key whose serrations coact with an edge of said openings, the tumblers being all retracted by the introduction of the serrated key corresponding to the combination of the lock, the bore of the stator comprising a reception hollow for each tumbler projecting from the rotor, characterized in that it comprises a slide movable transversely to the key channel, said slide comprising a passage opening for the key and a projection coacting with a recess of the stator in the locking position of the rotation of the rotor and returned elastically to said locking position by resilient return means, said slide having at least one notch coacting with a key member so as to drive transversely said slide toward an unlocking position for the rotation of the rotor.

The slide is positioned at the inlet of the rotor, the key member coacting with said slide being positioned at the end of the blade of the key, on the body of the key.

The notch of the slide can be formed in the passage opening for the key insert slide, the key member coacting with said notch being then constituted by a radial projection on the body of the key, the radial projection or the notch having an inclined plane arranged so as to drive the transverse displacement of the slide in the direction of retraction of the projection outside the recess of the stator against the action of the resilient return means.

The invention also has for its object a serrated key for a tumbler lock according to the invention, the blade of the serrated key corresponding to the combination of the tumblers or a combination for passing the tumblers and characterized in that it has a radial projection coacting with the notch of the slide provided in the opening for passage of the key.

The slide can also have at least one notch formed at its periphery. In this case, the key member coacting with said notch is an axial pin, the notch or the axial pin comprising an inclined plane arranged so as to drive a transverse displacement of the slide in the direction of retraction of its projection outside the recess of the stator.

The invention also has for its object a key for a lock according to the invention, said key having a serrated blade corresponding to the combination of the tumblers or to a pass combination to actuate the tumblers and at least one axial pin adapted to coact with a notch formed in the periphery of the slide.

The lock according to the invention can comprise a slide provided with a notch arranged in the key passage opening and at least one notch provided at the periphery of said slide. In this case, the lock can be manipulated by one or the other of the keys according to the invention mentioned above.

When the lock comprises a slide provided with a peripheral notch, a key has an axial pin adapted to coact with said notch. So as to guide the position of said key during its introduction, the lock comprises preferably a cap mounted fixedly on the stator and provided with a longitudinal slot for passage of the key positioned in correspondence with the key channel and having at least one through opening in which can engage an axial pin so as to coact with a peripheral notch of the slide so as to unlock the rotation of the rotor by disengaging the projection of the slide from the recess of the stator.

According to a preferred embodiment, the lock according to the invention also comprises, preferably interposed between the slide and the cap, a selector or filter provided with a key passage opening and having at least one surface visible from outside the lock, said selector comprising at least one through opening that can be positioned in coincidence with an opening traversing the cap, the selector being mounted rotatably on the stator. Thus, the selector can be positioned so as to present its through opening in coincidence with the through opening of the cap, the axial pin of a key being adapted to engage through said through openings to coact with a peripheral notch of the slide. Then, the driving in rotation of the selector by means of its visible surface, permits angularly offsetting the position of its through opening which, no longer being in coincidence with the through opening of the cap, closes the passage for said axial pin. It is thus possible to modify the combination of the lock so as to prevent access.

According to a preferred embodiment of this form of the invention, the lock has a combination modifiable over a large range of combinations. Preferably, the slide thus comprises several peripheral notches, preferably four, and the cap thus has transverse openings, preferably four, arranged so as to permit to each the passage of an axial pin to coact with a notch of the slide. The selector thus has transverse openings arranged relative to each other such that bringing into coincidence one of the transverse openings of the selector with a transverse opening of the cap prevents passage through at least one of the other transverse openings of the cap.

Because of this, a key must therefore have at least one axial pin positioned so as to engage through the cap and the selector by a free passage toward a notch of the slide, the key not being able to have an axial pin at a position corresponding to a passage prevented by the selector.

There is thus obtained, in a preferable manner, a lock with tumblers with a supplemental lockable member, whose combination is modifiable. It thus suffices to drive the selector in rotation to offset angularly the transverse openings of the selector and to modify the combination, a new free passage toward a notch of the slide being obtained by placing in coincidence another through opening of the selector with another through opening of the cap so as to form a new passage for an axial pin of a key.

As a result, when the combination has been modified, it is necessary either to change the key, the first having become inoperative, the passage of the axial pin of the key being closed, or to modify said key.

As a result, the invention also has for an object a key programmable for a lock according to the invention, said key having a serrated key blade corresponding to the combination of the tumblers or to a pass combination and said key comprising means for driving in axial displacement axial pins, between a position for retraction of the pins in the key and a projecting position of said pins.

Preferably, there is thus defined with the help of a selector a particular combination of the lock, the axial pins of the key being then positioned actively or not in the key as a function of said combination. There is thus obtained a lock with tumblers with a supplemental locking member whose combination is modifiable, said lock being manipulable with the help of a key whose combination is also programmable correspondingly.

According to a preferred modified embodiment of the invention and so as to increase the security by increasing the possible number of combinations, there can also be provided at least one additional through opening on the cap itself to permit the passage of an additional axial member on a key already having at least one axial pin. This member is different from the axial pins coacting with the peripheral notches of the slide, its positioning permitting enlarging the range of combinations.

Preferably, there is emplaced in the lock, an additional selector mounted rotatably on the stator, and having preferably a visible surface outside the lock, said selector being provided with a key passage opening and being arranged so as not to prevent the passage of axial pins and to have at least one through opening adapted to be positioned in coincidence with an additional through opening of the cap.

A programmable key according to the invention can also comprise, additionally, drive means for extending or retracting said members so as to modify the key as a function of the combination of the lock.

The invention also has for its object a tool for programming the combination of the supplemental locking member of the lock according to the preferred form of the invention, said tool comprising at least means for driving in rotation the first selector and, additionally, means for driving in rotation the additional selector, said means permitting driving in rotation the selectors so as to modify the combination of the lock.

A programmable key according to the invention can also comprise additional axial members, said key body comprising means suitable to permit their axial displacement between a retracted position in the body of the key and a position projecting from the body of the key as a function of the combination of the lock. This preferred embodiment of the lock according to the invention can be used on computers of a computer depot. Each lock having a combination of tumblers which is individual to itself but having a combination of the second locking member which is common to all the computers of the depot, the slide being of the type having peripheral notches and a notch provided in the opening of the key passage.

As a result, there is provided a given key to the user to operate the lock of his apparatus, which has a serrated blade corresponding to the combination of the tumblers and a radial projection adapted to coact with the notch formed in the key passage opening of the slide, whilst there is provided a partial pass key permitting access to all the apparatus of the computer depot, this key being of the programmable type, which is to say comprising a serrated key blade corresponding to the pass combination of the tumblers and provided with axial notches adapted to coact with the peripheral notches of the slide and arranged to be positioned projecting from the key body or withdrawn so as to correspond to the combination defined by the position of the selector in the lock. Said key can also have additional axial members which can also be positioned projecting from the body of the key or being protected as a function of the combination defined by the additional selector in the lock.

The combination of said lock is modifiable with the help of a programming tool according to the invention, for example when an enlargement of the computer depot is carried out, the locks of the former apparatus and of the new apparatus being thus programmed so as to have a same lock combination, the partial pass key being then programmed in correspondence to the new combination.

Preferably, the combination of the lock is modified without having to operate on the tumblers, the partial pass key being easily programmable correspondingly.

There is also provided a general pass key which comprises a serrated blade corresponding to the pass combination of the tumblers and a radial projection adapted to coact with the notch provided in the key passage opening of the slide.

BRIEF DESCRIPTION OF THE DRAWINGS

There will now be described in greater detail a preferred embodiment of the invention with reference to the accompanying drawings, in which.

DESCRIPTION OF THE PREFERRED EMBODIMENTS

Figure 1A:
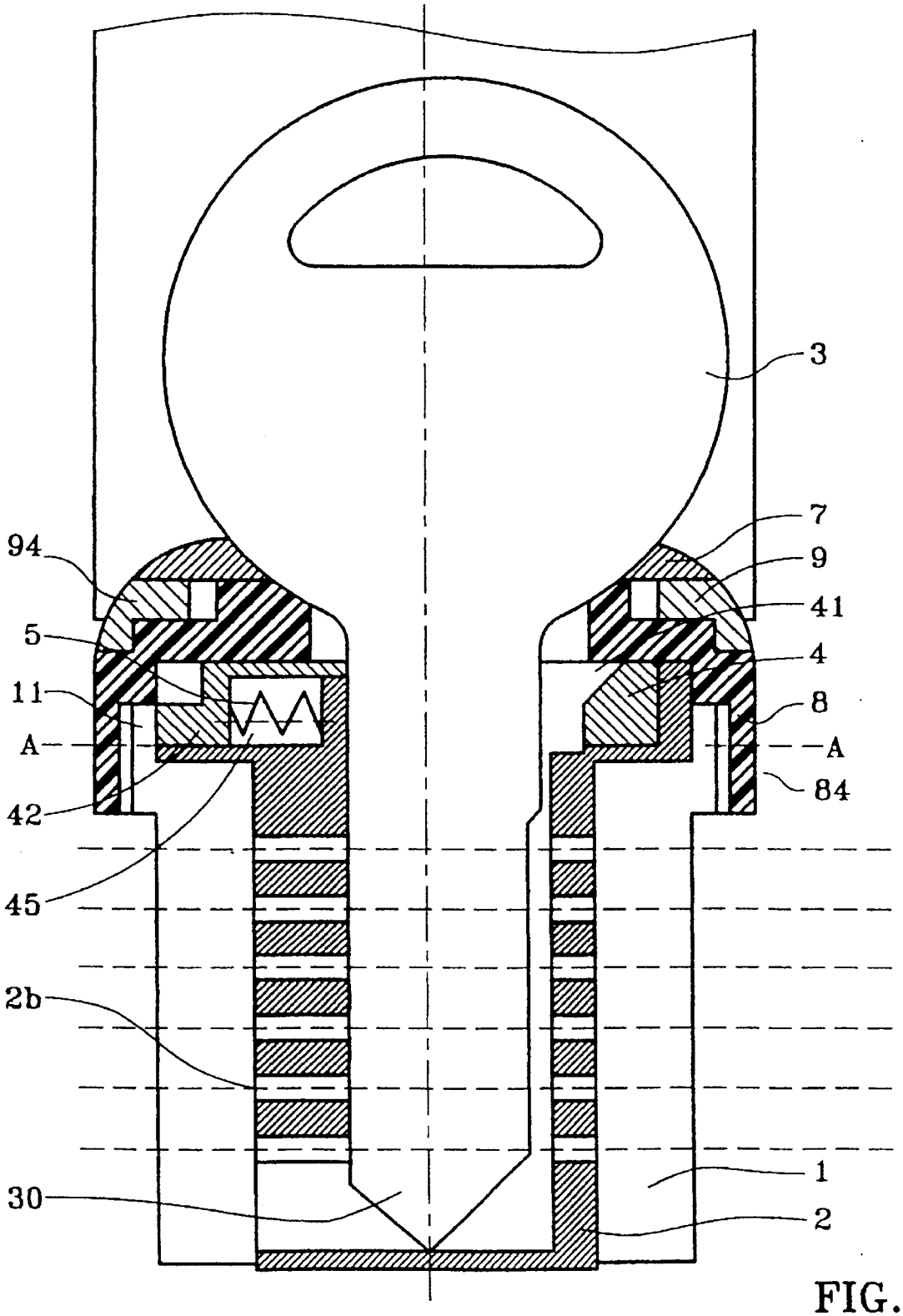
FIG. 1*a* is a longitudinal cross-sectional view of a lock according to the invention into which is introduced a key.

The lock according to the preferred embodiment of the invention comprises a stator body 1 provided with a longitudinal bore in which rotates a barrel or rotor 2. The rotor 2 comprises a longitudinal blind slot provided with a key inlet for the introduction of a serrated key 3 (the serrations are not shown for purposes of clarity), the rotor 2 comprising a plurality of transverse through slots 2*b* crossing the longitudinal slot, in each of which is mounted a tumbler (not shown) pushed outwardly of the rotor 2 by a spring, each tumbler comprising a window arranged to be traversed by a key 3 whose serrations coact with an edge of said windows, the tumblers being all pushed out of the way by the introduction of the serrated key 3 corresponding to the combination of the lock, the bore of the stator 1 comprising a hollow for the reception of each tumbler projecting from the rotor 2. The structure and operation of this portion of the lock is known per se, and will not be described in greater detail.

The lock moreover comprises a supplemental locking member for the rotation of the rotor 2 in the stator 1 whose combination is modifiable. This locking member is constituted by a slide 4 movable transversely in the key channel defined in the lock and positioned at the entry of the rotor 2.

This slide 4 comprises an opening 41 for passage of the key and a projection 42 coacting with a recess 11 provided in the stator 1, in the locked position of the rotor 2.

The projection 42 is urged toward a locking position in the recess 11 of the stator 1, by resilient return means such as a spring 5 whose one end is fixed to the rotor 2 and the other end to the slide 4, said spring 5 being disposed in a compartment 45 provided in the thickness of the slide 4.

When the slide 4 is in the position to lock the rotation of the rotor 2, the key passage opening 41 has dimensions suitable to permit the passage of a key 3, in particular the key blade 30 having serrations (not shown).

The slide 4 preferably has four peripheral notches 43. These notches 43 are defined so as to be able to coact respectively with a key member such as an axial pin 31 of the key 3 as can be seen in FIG. 1*b*, an axial pin 31 being engaged in a notch 43.

There is disposed at the entrance of the lock a cap 7 of circular cross-section mounted fixedly on the stator 1 by means of securement tongue 71, this cap 7 being provided with a longitudinal slot 72 for entry of the key position in correspondence with the key channel of the lock. The cap 7 comprises moreover four through openings 73 in each of which can engage an axial or, 3, of a key so as to coact with four peripheral notches 43 of the slide 4.

Between the cap 7 and the slide 4, there is disposed a selector or filter 8 so as to close or to free certain of the passages of axial pins 31, extending toward the peripheral notches 43 of the slide 4, said selector 8 being mounted rotatably on the stator 1 and having a visible surface 84 outside the lock such that its driving in rotation permits changing the combination concerning the closure or opening of said passages for the axial pin 31.

Preferably, the selector 8 is constituted by a circular cross-section ring provided with a small collar 81 projecting radially inwardly, defining a key passage opening 82, said small collar 81 having through openings 83 whose distribution on said small collar 81 is selected such that, when at least one through opening 83 is placed in coincidence with a through opening 73 of the cap 7, at least one other through opening 73 of the cap is in coincidence with a solid portion of the small collar 81, the passage of the axial pin 31 defined by said opening 73 being thus closed.

The driving in rotation of the selector 8 permits offsetting angularly the through openings 83 and modifying the combination of the lock.

Preferably, the cap 7 comprises additional through openings 74, adapted to permit the passage of at least one axial member 32 provided additionally on the key so as to enlarge the range of combinations of the lock.

There is thus provided a second selector or filter 9 in the form of a circular section ring provided with a small collar 91 projecting radially inwardly of the ring and mounted rotatably on the stator 1, said small ring 91 defining a key passage opening 92 and having at least one through opening 93, preferably two openings 93, that can be placed in coincidence with additional through openings 74 of the cap 7 so as to provide a passage for an additional axial member 72 once the other additional through openings 74 are masked by a solid portion of said small collar 91.

Preferably, the additional selector 9 is emplaced on the selector 8 under the cap 7 and has a visible surface 94 outside the lock so as to be able to be driven in rotation. The width of the small collar 91 is selected such that it is not located in the passage for the axial pins 31.

So as to drive in transverse displacement the slide 4 to unlock the rotation of the rotor 2, an axial pin 31 coacting with a peripheral notch 43 has preferably an inclined plane 31*a* (see FIG. 6) and is positioned such that, upon the introduction of the key, the end of the axial pin 31 first coacts with the edge of the peripheral notch 43 of the slide 4, the edge of the peripheral notch 43 sliding, during continued introduction of the key, along the inclined plane 31a such that the slide 4 is driven to move transversely of the key channel, said inclined plane 31*a* being selected to give rise to a displacement adapted to disengage the projection 42 of the slide 4 from the recess 11 of the stator 1.

Figure 1B:
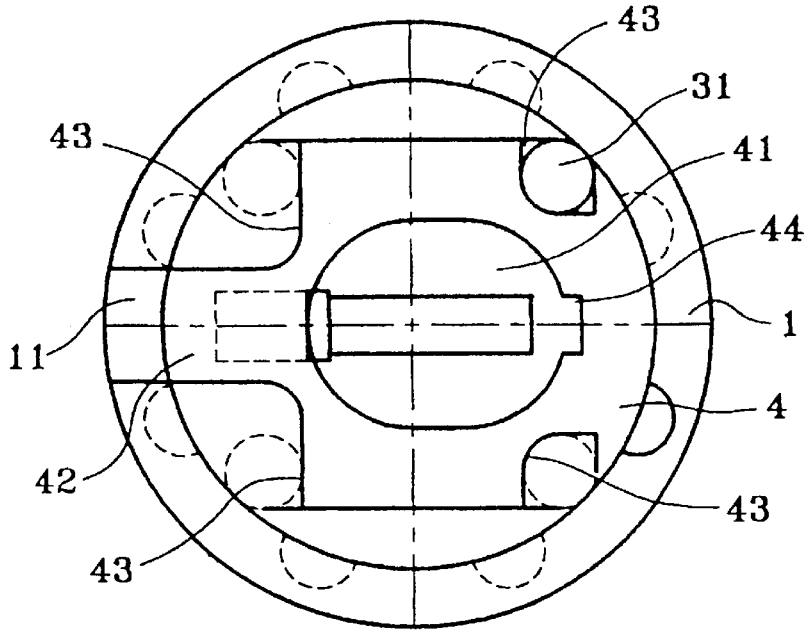
FIG. 1*b* is a transverse cross-sectional view on the line A—A of the lock according to FIG. 1*a;*
Figure 2A:
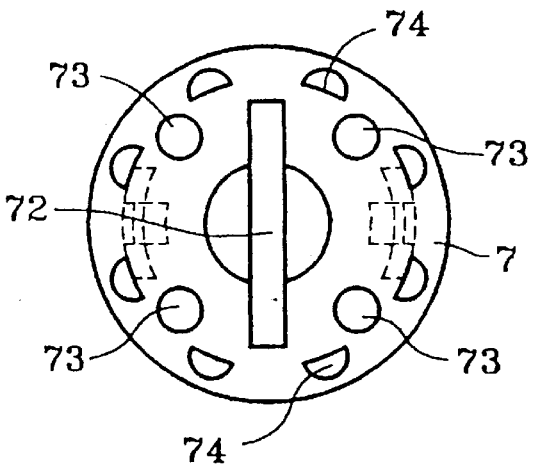
FIGS. 2*a* and 2*b* are plan and transverse cross-sectional views of a cap of the lock according to FIG. 1.
Figure 3A:
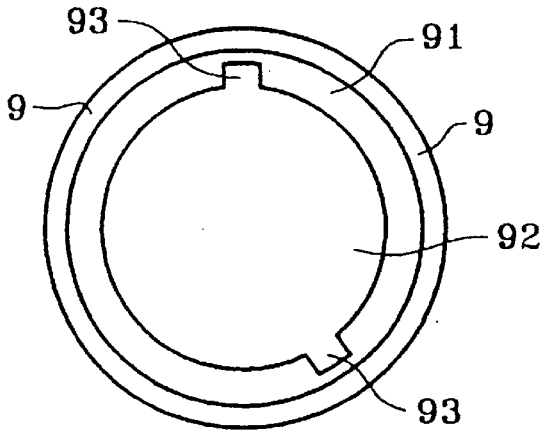
FIGS. 3*a* and 3*b* are plan and transverse cross-sectional views of an additional selector for a lock according to FIG. 1.
Figure 2B:
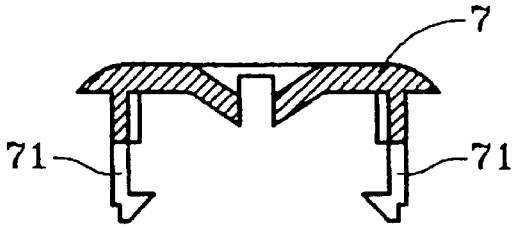
Figure 3B:
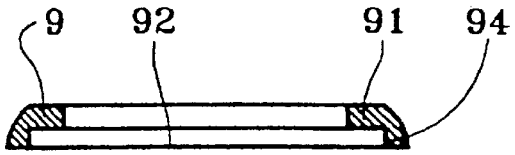
Figure 4A:
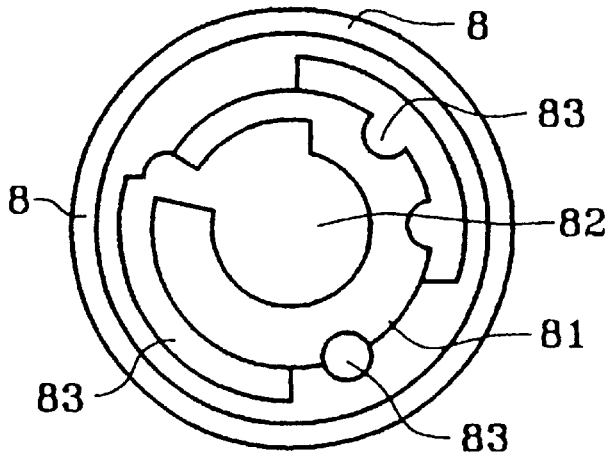
FIGS. 4*a* and 4*b* are plan and transverse cross-sectional views of a selector of a lock according to FIG. 1.
Figure 4B:
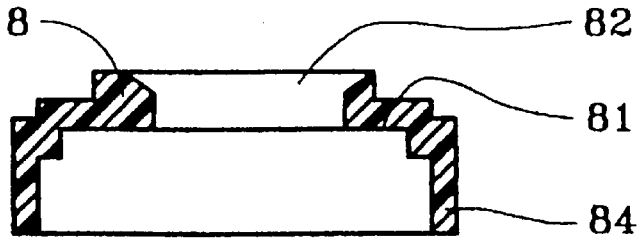
Figure 5A:
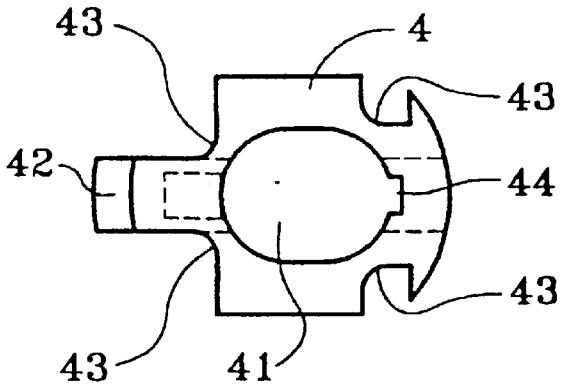
FIGS. 5*a* and 5*b* are plan and transverse cross-sectional views of a slide of a lock according to FIG. 1.
Figure 5B:
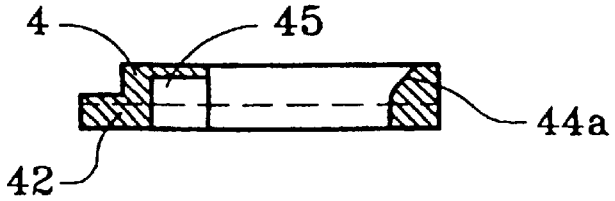

So as to modify the combination of the lock of FIG. 1, the two selectors 8 and 9 are driven in rotation according to a new angular combination with the help of a programming tool for the combination of the lock, comprising means for driving in rotation said selectors 8 and 9, said means being arranged to come into engagement with the visible surfaces 84 and 94 of said selectors 8 and 9 outside the lock.

Figure 6:
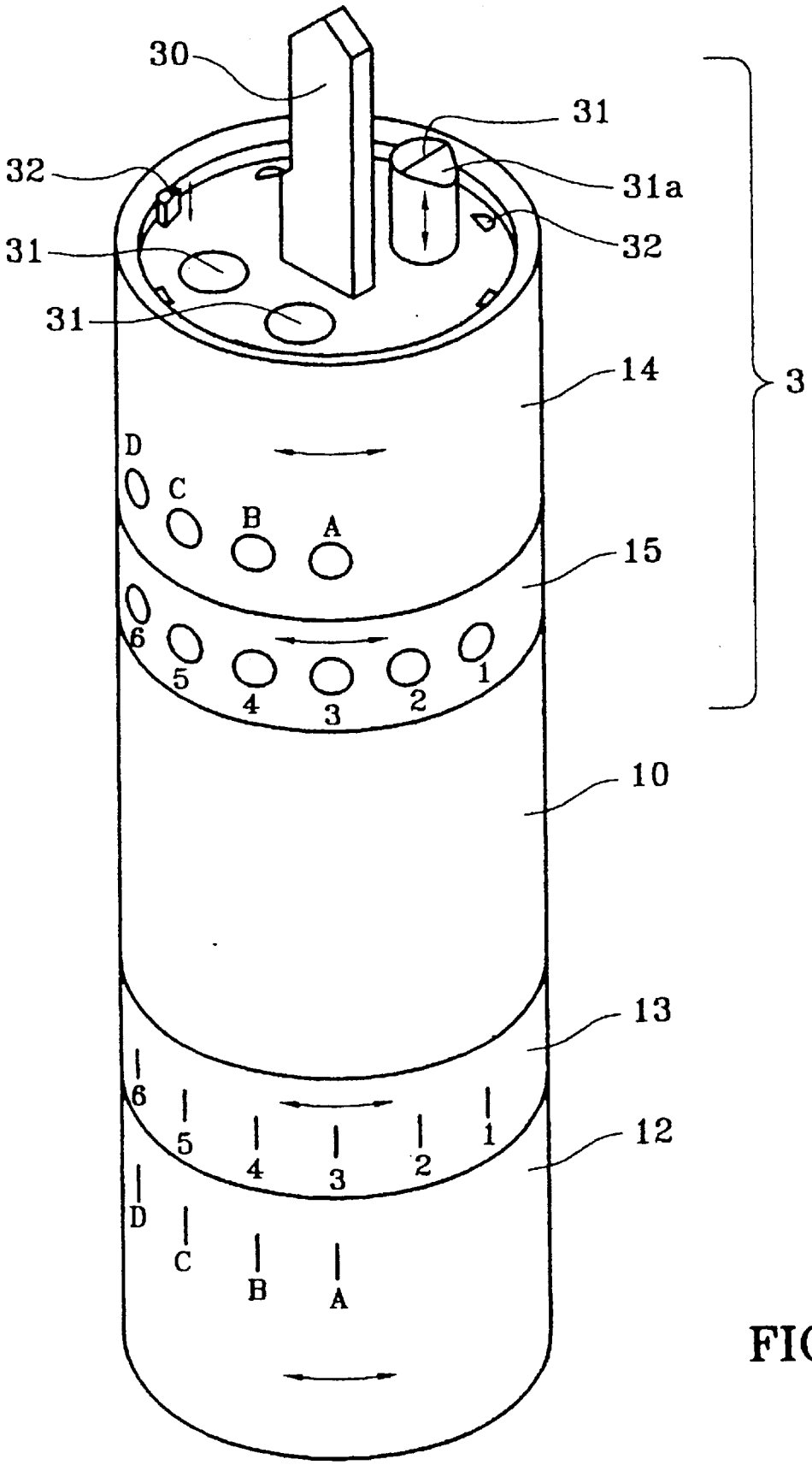
FIG. 6 is a schematic side elevational view of a tool comprising both a programmable key according to the invention and a programming tool for the lock combination.

Preferably, the indexing of the selectors 8 and 9 is carried out by snap engagement means known per se. FIG. 6 shows a preferred embodiment of a programming tool for the combination of a lock according to the invention, in the form of a cylinder 10 having a first hollow end constituted by two rings 12 and 13 drivable in rotation, the end of the cylinder 10 having rings 12, 13 engaging over the external portion of the lock, the first ring 12 having means adapted to coact with the visible surface 84 of the selector 8 to drive it in rotation and the second ring 13 having means suitable to coact with the visible surface 94 of the selector 9 to drive it in rotation.

Preferably, the other end of the cylinder 10 can constitute a programmable key for the lock, said key 3 having a key blade 30 provided with serrations corresponding to the combination of the tumblers, four axial pins 31 adapted to coact with the four notches of the slide 4 and axial members 32, the cylinder 10 enclosing drive means for axial displacement between a projecting position and a retracted position of the pins 31 and the members 32. The axial movement drive means for the pins 31 and the members 32 can be actuated by the rotation of a ring 14 and a ring 15. The projection of said pins and members is defined as a function of the combination of the lock.

Figure 7:
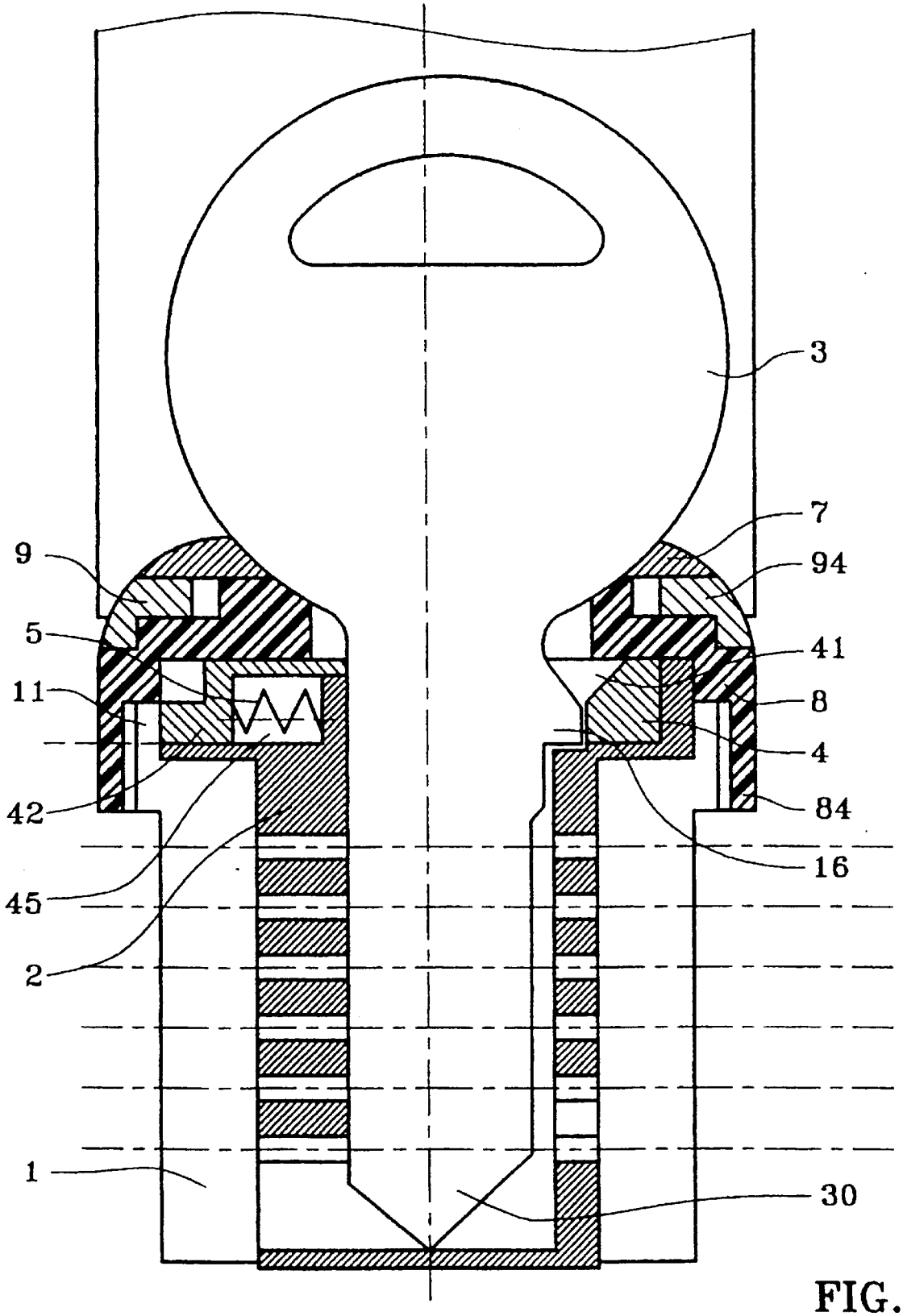
FIG. 7 is a longitudinal cross-sectional view of a lock according to FIG. 1 in which another key for manipulating said lock is introduced.

FIG. 7 shows a lock according to FIG. 1 in which is introduced a key 3 comprising a radial projection 16 adapted to coact with a notch 44 provided in the key passage opening 41 of the slide 4. Preferably, this notch 44 is formed in the key passage opening 41 on the side of said opening 41 opposite the projection 42 and has an inclined plane 44*a* which, coacting with the radial projection 16, drives the transverse displacement of the slide 4 so as to disengage the projection 42 of said side outside the recess 11 of the stator 1.

What is claimed is:

1. Assembly comprising a tumbler lock with the appropriate key, the lock comprising a barrel or rotor (2) turning in the bore of a lock body or stator (1), said rotor (2) comprising a blind longitudinal slot provided with a key inlet for the introduction of a serrated key (3), said rotor (2) comprising a plurality of transverse through slots (2*b*) and crossing the longitudinal slot in each of which is mounted a tumbler urged to project from the rotor (2) by a spring, each tumbler comprising a window arranged to be traversed by the key (3) whose serrations coact with an edge of said windows, the tumblers being all retracted by introduction of the serrated key (3) corresponding to the combination of the lock or to a pass combination, the bore of the stator (1) comprising a hollow for reception of each tumbler projecting from the rotor (2), the lock moreover comprising a slide (4) movable transversely to the key channel, said slide (4) comprising an opening (41) for passage of a key and a projection (42) coacting with a recess (11) on the stator (1) in the locking position of rotation of the rotor (2) and resiliently urged to said locking position by means of resilient return means (5), said slide (4) having at least one peripheral notch (43) coacting with an axial pin (31) secured to the key so as to drive transversely said slide (4) toward a position for unlocking the rotation of the rotor (2), said pin (31) for the peripheral notch (43) having an inclined plane arranged so as to drive the transverse movement of the slide (4) in the direction to retract said projection (42) from the recess (11) of the stator (1).

2. Lock according to claim 1, wherein the lock comprises a cap (7) mounted fixedly on the stator (1) and provided with a longitudinal slot (72) for passage of a key, said cap (7) having at least one through opening (73) in which can engage an axial pin (31) of a key (3) to coact with a peripheral notch (43) of the slide (4).

3. Lock according to claim 2, wherein the lock comprises a selector or filter (8) provided with an opening (81) for passage of a key and having a surface (84) visible outside the lock, said selector (8) comprising at least one through opening (83) that can be positioned in coincidence with a through opening (73) of the cap (7), the selector (8) being mounted rotatably on the stator (1).

4. Lock according to claim 2, wherein the cap (7) has at least one additional through opening (74) adapted to permit the passage of an additional axial member (32) provided on the key.

5. Lock according to claim 4, further comprising an additional selector (9) mounted rotatably on the stator (1) and having a surface (94) visible outside the lock, said selector (9) being provided with an opening (92) for passage of a key and being arranged so as not to prevent the passage of axial pins (31) and to have at least one through opening (93) adapted to be positioned in coincidence with an additional through opening (74) of the cap (7).

6. Key for an assembly according to claim 1, further comprising a serrated key blade corresponding to the combination of the tumblers or to a pass combination, and at least one axial pin (31) adapted to coact with a notch (43) formed in the periphery of the slide (4).

7. Key according to claim 6, further comprising at least one additional axial member.

8. Key according to claim 6, further comprising means for driving in axial displacement the axial pins and, additionally the axial members, between a retracted position for the pins and members in the key and a projecting position of said pins and members.

9. A tool for programming the combination of the supplemental locking member of a tumbler lock according to claim 3, said tool comprising a ring for driving in rotation the first selector, said ring (12, 13) being arranged to come into engagement with the visible surface (84, 94) of said selector (8, 9) outside the lock.

* * * * *